United States Patent [19]

Gatling

[11] Patent Number: 4,773,385

[45] Date of Patent: Sep. 27, 1988

[54] UNIVERSAL ENERGY ADAPTOR INCREASER

[76] Inventor: Grafton G. Gatling, Rte. 1, Box 116A, Eure, N.C. 27935

[21] Appl. No.: 502,681

[22] Filed: Jun. 9, 1983

[51] Int. Cl.[4] ..... F24B 5/02

[52] U.S. Cl. ..... 126/77; 98/48; 126/112; 110/160; 110/214

[58] Field of Search ..... 126/117, 112, 77, 110 AA, 126/103; 431/215; 60/39.23; 237/55; 110/203, 214, 160; 98/48

[56] References Cited

U.S. PATENT DOCUMENTS

| | | | |
|---|---|---|---|
| 441,567 | 11/1890 | Jahant | 126/112 |
| 495,740 | 4/1893 | Kille | 126/112 |
| 665,947 | 1/1901 | West | 126/77 |
| 805,463 | 11/1905 | Herrick | 126/77 |
| 1,234,154 | 7/1917 | Gray | 126/112 X |
| 1,254,777 | 1/1918 | Colegrove | 126/112 |
| 1,434,228 | 10/1922 | Sanborn | 110/304 |
| 2,243,503 | 5/1941 | Frenette | 126/117 X |
| 2,845,882 | 8/1958 | Bratton | 110/346 |
| 3,610,179 | 10/1971 | Shaw | 110/346 |
| 3,614,949 | 10/1971 | Goodgion | 126/110 AA |
| 4,054,028 | 10/1977 | Kawaguchi | 60/39.23 |
| 4,171,612 | 10/1979 | Zwick | 60/39.23 |
| 4,184,473 | 1/1980 | McIntire et al. | 126/77 |
| 4,265,215 | 5/1981 | Curry | 126/77 |
| 4,319,556 | 3/1982 | Schwartz et al. | 126/15 A |
| 4,343,288 | 8/1982 | Tjosvold | 126/112 |
| 4,389,980 | 6/1983 | Mascotte et al. | 126/112 |
| 4,408,716 | 10/1983 | Rockwell | 126/77 |
| 4,409,955 | 10/1983 | Christian | 126/112 |
| 4,414,957 | 11/1983 | Evans | 126/121 |
| 4,471,751 | 9/1984 | Hottenroth et al. | 126/77 |

FOREIGN PATENT DOCUMENTS

| | | | |
|---|---|---|---|
| 215373 | 9/1941 | Switzerland | 126/77 |
| 526624 | 9/1940 | United Kingdom | 126/77 |

OTHER PUBLICATIONS

Gay, "Wood Furnaces and Boilers", Garden Way Bulletin, A-25 (Jan. 1978).

*Primary Examiner*—Samuel Scott
*Assistant Examiner*—Helen A. Odar
*Attorney, Agent, or Firm*—R. L. Spicer, Jr.

[57] ABSTRACT

This invention is an attachment for installation along a flue duct between a heater and a chimney, including a flue duct section, having a jet tube therein, receiving air from an exterior motor-driven fan, so as to create a vortex and a third stage burner at the jet tube end.

6 Claims, 2 Drawing Sheets

UNIVERSAL ENERGY ADAPTOR INCREASER

This invention relates generally to house heating plant attachments. More specifically, it relates to heat efficiency devices.

It is well known that, with the increasing costs of fuel energy in modern times, a great deal of attention is given to how this problem may be solved. Accordingly, in the recent past, numerous devices have been developed in trying to get improved heat from existing heating plants, and while some success has been accomplished, it is still not ideal, so that there yet remains a need for further improvements.

It should be pointed out that the reference relating to the use of the term one hundred percent as stated below, is referred to by assuming that the prior art heater units, are rated at one hundred percent, as a norm, for their present efficiency, prior to being adapted for use with applicant's apparatus. Consequently, the results of the improvement in efficiency of the same prior art heater units, provide an additional higher rating, in the multiple of one hundred percent, when using applicant's device therewith.

Therefore, it is a principal object of the present invention to provide an attachment, which, in actual tests on five different wood and coal heaters and furnaces, has resulted in an increase in heat efficiency from one hundred to two hundred percent, while decreasing fuel consumption, and being able to heat large areas.

Another object is to provide an attachment, which accordingly has considerably decreased air pollution, while it is noticed that the deposit of creosote inside chimneys has decreased better than five hundred percent.

Another object is to provide a universal adaptor energy increaser, that has brought the wood and coal burning products into the safety range zone of oil and gas, and which permits a heating unit to be operated by automatic controls, thus eliminating the conventional frequent attention of a home owner to keep a fire going. When it is installed in a wood or coal heater, all manual drafts are locked off and forgotten; the attachment performing all the fire control directly from the setting of a thermostat.

A furnace that has wood, coal, oil, etc. as fuel and which requires the use of heat, fuel and air for combustion, unlike an electric furnace, the fuel does not completely burn, i.e., there are residue particles of the fuel that has not completely burned and are contained within the exhaust gases. These residue particles collect on the exhaust pipe and chimney in the form of soot, glaze, creosote, etc. These collections catch fire when a very hot fire is produced within the fire box and sometimes catch the chimney on fire and at times even burn a house down. This invention, allows all of the fuel particles to be completely burned. This provides for a safe, friendly fire and an increase in heat with the use of less fuel.

Accordingly, a further object is to provide a universal energy adaptor increaser, which, by being within the safety range zone of automatically controlled heating equipment, reduces the danger of chimney fires in homes heated by wood or coal, preventing the burning down of these homes and the great loss of lives associated therewith.

Other objects are to provide a universal energy adapter increaser, which is simple in design, inexpensive to manufacture, rugged in construction, easy to use, and efficient in operation.

These, and other objects, will be readily evident, upon a study of the following specification, and the accompanying drawing, wherein.

Figure 1:
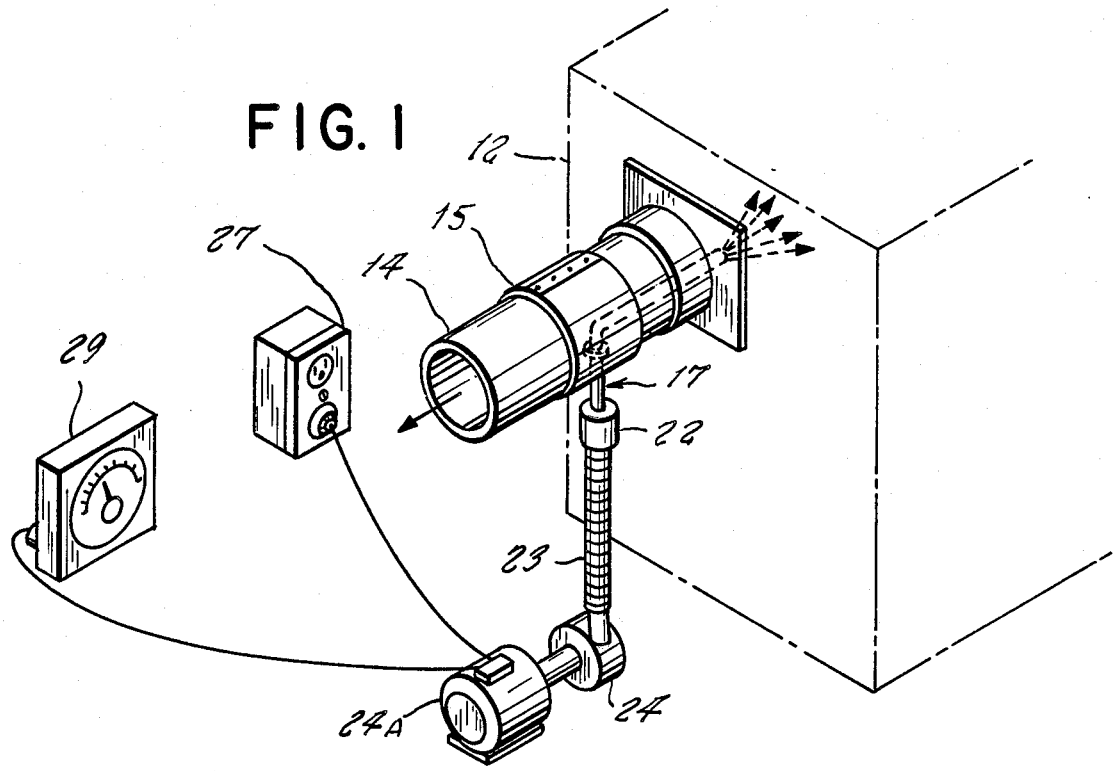
FIG. 1 is a schematic perspective view of the embodiment of the invention.
Figure 2:
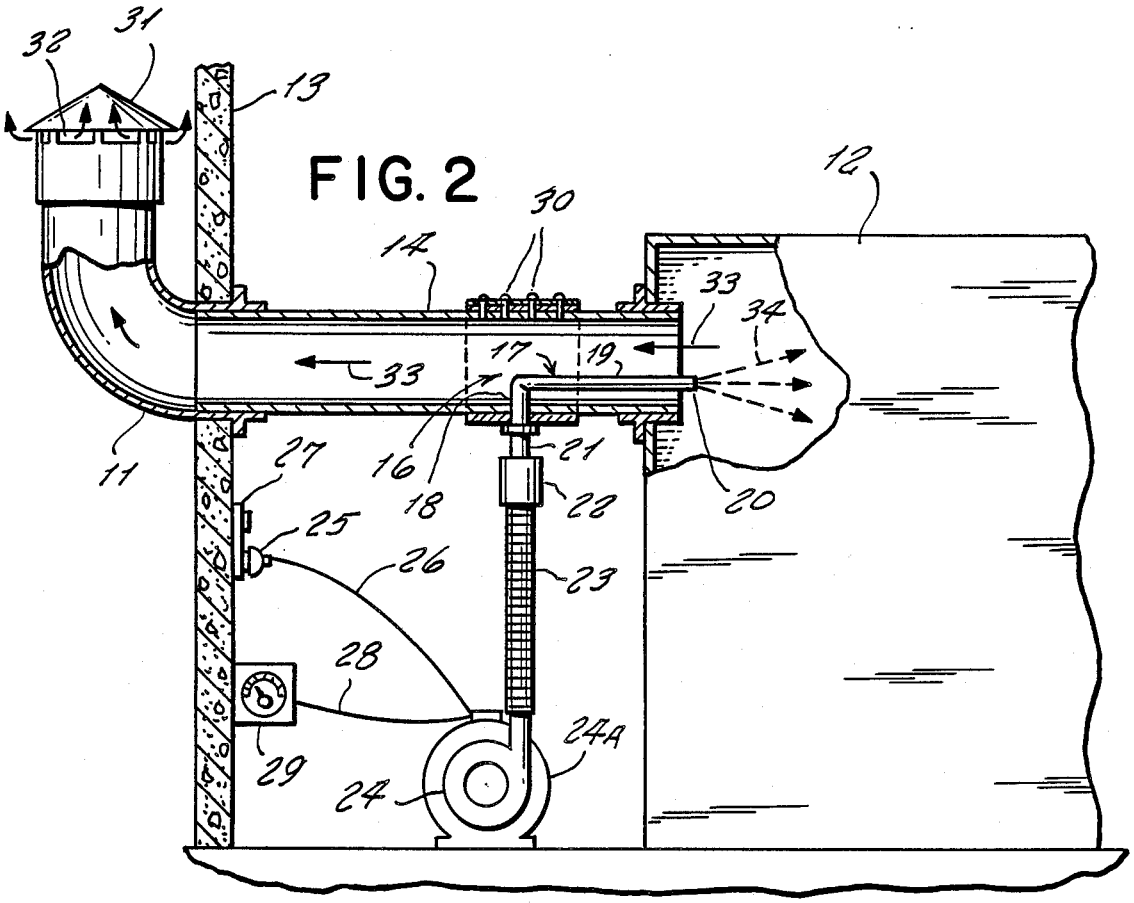
FIG. 2 is a side elevational view, shown partially in cross-section, of the embodiment of the invention.

Referring now to the drawings in greater detail, the FIGURES represent a universal energy adapter increaser, according to the present invention, and which is attachable to a flue duct 11, that extends between a heater 12 and a chimney 13.

The device includes a flue duct section 14, having a collar 15 fitted therearound; the collar providing a rigid support for a jet assembly 16, that includes a jet tube 17, bent at right angles, and which extends through a snug hole 18 made in the side wall of the collar and duct section 14. The end portion 19 of the jet tube, which extends into the duct section 14, extends axially parallel thereto, and is of a length so that a jet blast opening 20, on a terminal end thereof, products into the interior of the heater. An outward extending end portion 21 of the jet tube has a fitting 22 on its terminal end, for connection to a flexible tubing 23, that may be sheathed in an armored, flexible gooseneck, as shown. The flexible tubing is connected to an outlet port of an electrically powered fan 24. While the jet tube portion 19 is shown to be straight, it may be made spiralled along its generally longitudinal axis.

The fan motor 24A may be conveniently installed upon a floor, and it is connected by a plug 25, on an extension cord 26, to an electric power source receptacle 27. The fan motor is also connected by an electric cable 28 to a calibrated thermostat 29.

As shown in the drawing, the collar may be formed from a flat stock that is rolled up around the flue section, and the opposite ends of the stock are then fastened together by means of rivets 30.

As also shown in the drawing, the end of the flue duct extending into the chimney may be turned upwardly, and fitted on its end with a hood 31 to protect outlets 32.

In operative use, it is now evident that, as the hot waste gases and smoke from the heater move through the flue duct directly toward the chimney, as indicated by arrows 33, they pass around the jet tube 17, through which air from the fan is blown in an opposite direction, as indicated by arrows 34, and ejected out of the jet blast opening 20 into the heater, creating a vortex and third stage burner at the jet blast opening.

Figure 3:
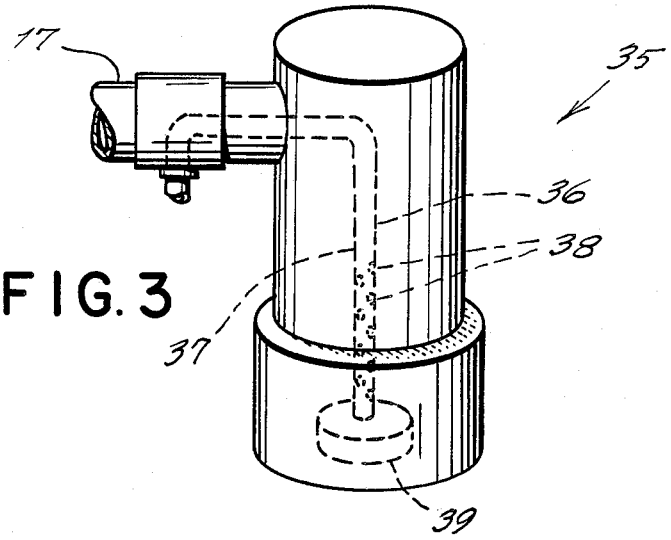
FIG. 3 is a fragmentary perspective view of a typical oil burner adapted to use the embodiment of the invention.

Reference is now made to FIG. 3, wherein a modified design 35 of the above indicated jet tube 17 is altered for an oil heater by terminating at the side wall of the collar, and only an oil feed tube 36, through the center of the jet tube 17, continues into the collar interior where an end portion 37 of the oil feed tube extends axially parallel thereto, and is provided with oil jet holes 38. A wide flange 39 is on a terminal end of the oil feed tube.

Figure 4:
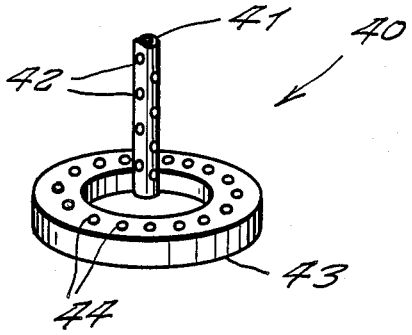
FIG. 4 is a fragmentary perspective view of a typical gas burner adapted to use the embodiment of the invention.

In FIG. 4, another design 40 thereof is shown for a gas heater, and wherein a gas pipe 41 is perforated with gas jet holes 42, while a circular terminal portion 43 of the gas pipe includes gas jet holes 44.

Figure 5:
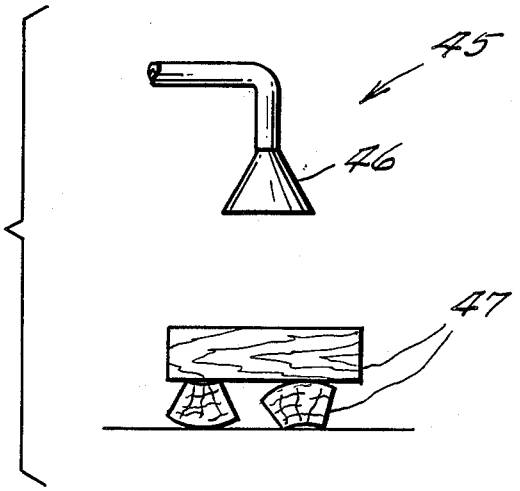
FIG. 5 is a fragmentary side elevational view of a typical wood burner adapted to use the embodiment of the invention, and which is also adaptable for use on all coal type burners.

Referring now to FIG. 5, still another design 45 is shown, for use on certain types of wood burning furnaces. This includes a flaring end piece 46 on an end of the jet tube 17, so that air from the fan is spread across the burning fuel 47.

While various changes may be made in the detail construction, it is understood that such changes will be within the spirit and scope of the present invention, as is defined by the appended claims.

What I claim as new is:

1. A universal energy adapter increaser for providing a primary and only air supply to a heater unit, having in combination, an attachment along a flue duct located between a heater unit and a chimney, said attachment having a duct engaging support collar section adapted to be secured to a portion of said flue duct, a jet assembly supported by said collar and having a jet tube, one end of said tube adapted to extend through alligned air-tight openings in both the collar and flue side walls, a portion of said jet tube being bent at a right angle and housed within the flue, said tube extending axially parallel with the flue duct a given length so that it extends into the heater combustion chamber, said tube one end portion provides a jet blast at its opening, and the other extending end portion of the jet tube having a fitting at its terminal end adapted for connection to the only air source to be used by the heater.

2. An air tight heater having side walls, a fuel receiving combustion chamber, an exhaust flue duct extending through a side wall opening in said heater and being integrally secured to said side wall at said opening, a collar fitted around a portion of said flue duct and fastened thereto, a jet assembly supported by said collar and having a jet tube, one end of said tube extending through aligned air-tight openings in the side walls of both the duct section and collar, said tube having a portion bent at a right angle and housed within the flue, said tube extends axially parallel within the flue duct a length which extends to the interior of the heater combustion chamber, a jet air blast is provided at the tube end which extends into the interior of the furnace, the other end of said jet tube having a fitting thereon for connecting said tube to an external air source which provides the only air supply used by the heater.

3. The combination as set forth in claims 1 or 2 wherein said flue duct is fitted with a hood.

4. The combination as set forth in claims 1 or 2 wherein said heater has a calibrated heat responsive thermostat located within an area to be heated to actuate a fan motor which provides the required air source needed for the furnace.

5. The combination as set forth in claims 1 or 2 wherein the jet tube end which extends into the heater, creates a vortex effect within the combustion chamber.

6. The combination as set forth in claims 1 or 2 wherein the other end of said jet tube is connected to a blower by a flexible tube.

* * * * *